United States Patent [19]

Corse

[11] 4,129,065

[45] Dec. 12, 1978

[54] APPARATUS FOR GROOVING SHEET MATERIAL

[75] Inventor: Louis G. Corse, Chaumont-sur-Tharonne, France

[73] Assignee: Machines Chambon, Orleans, France

[21] Appl. No.: 755,164

[22] Filed: Dec. 29, 1976

[30] Foreign Application Priority Data

Jan. 8, 1976 [FR] France ..... 76 00301

[51] Int. Cl.[2] ..... B26D 3/08; B31F 1/00

[52] U.S. Cl. ..... 93/58 ST; 93/1 G; 93/58.3

[58] Field of Search ..... 93/58 ST, 58.3, 58 R, 93/1 G, 1 R

[56] References Cited

U.S. PATENT DOCUMENTS

| | | | |
|---|---|---|---|
| 1,187,144 | 6/1916 | Hawkins | 93/58.3 |
| 1,340,558 | 5/1920 | Plummer | 93/58.3 |
| 2,781,095 | 2/1957 | Spinner | 93/1 G |
| 2,949,827 | 8/1960 | Kempen et al. | 93/58 ST |

*Primary Examiner*—James F. Coan

*Attorney, Agent, or Firm*—J. Harold Nissen

[57] ABSTRACT

A method of grooving sheet material along a line about which the material is subsequently to be folded comprises the step of forming, along said line, an impression. The impression forms a groove on one side of the material, the groove being intended to form the outer face of the edge of the fold when the material has been folded. The impression also forms, on the other side of the material, a corresponding bead which is intended to be located on the inside of the fold. Two parallel and opposite lines of elongate depressions are formed in the bead during the formation of the impression, the lines of depressions being formed one on each side of the central longitudinal axis of the bead. Each depression is constituted a portion of material which is of reduced thickness and which creates a localized zone of reduced strength.

6 Claims, 5 Drawing Figures

APPARATUS FOR GROOVING SHEET MATERIAL

BACKGROUND OF THE INVENTION

This invention relates to a method of, and apparatus for, grooving a flat thin material, comprising fibres aligned in at least one direction, such as cardboard, paper and all composite materials of this kind.

Hitherto, the grooving or scoring of cardboard to enable it to be subsequently folded has been carried out on large platen presses operating on the flat material, in the case of small-scale production, or on rotary machines in the case of production on a larger scale. In both of these cases, the problem of grooving in the direction of the fibres of the cardboard has arisen.

The purpose of grooving is to separate the lines of fibres so that upon subsequent folding of the cardboard along the fold-line or fold-lines provided, these fibres do not form a compact body that offers excessively great resistance to folding. Cardboard has a fibrous structure consisting of a large number of longitudinal fibres disposed very close to each other, and a considerably smaller number of transverse fibres which are spaced relatively widely from each other.

Grooving of the cardboard does not raise any difficulties in the direction transverse to that of the fibres, but this is not so in the longitudinal direction. For the purpose of grooving, use is generally made of a tool in the form of a blade which has a rounded, rectangular pointed or trapezoidal end portion and which is displaced relatively to a hollow zone formed in a platen acting as a backing member. The end of the blade terminates substantially in the plane of the oppositely disposed face of the backing member, and in this zone the lateral surface of the blade is located at a distance from edges which delimit the hollow zone in the backing member, which distance is substantially equal to the thickness of the cardboard sheet. Thus, the blade pushes that portion of the cardboard that faces it into the hollow portion in the backing member, and said portion of the cardboard is then firmly applied against the lateral surface of the blade. This grooving operation results in division of the lines of fibres i.e. in separation of the fibres, and in the scoring of a concave folding line in the cardboard. Upon subsequent folding of the cardboard, the outer edge of the fold is formed by a tensioned portion which should not break open for reasons of appearance as well as of strength.

Though the separation of the lines of fibres in the transverse direction does not pose any particular problem, this is not the case in the longitudinal direction. In the latter case, separation of the lines of fibres occurs in a considerably less effective manner, and the force required for subsequently folding the cardboard is relatively great.

It is generally considered that the force necessary for longitudinally folding cardboard that is grooved transversely of the fibres should be less than 50 percent of the force necessary for folding ungrooved cardboard, whereas the force required for transversely folding cardboard that has been longitudinally grooved in relation to the fibres should be less than 60 percent of the force necessary for folding ungrooved cardboard. Generally however, in the case of poor-quality cardboard, which is preferred for industrial purposes since it is the cheapest, it will be found that the force necessary for folding the cardboard in the transverse direction, that is to say parallel to the longitudinal fibres, may be as much as ninety percent of the force necessary for folding the ungrooved cardboard, because of inefficient division or separation of the fibres in this direction.

For the purpose of achieving efficient division in the direction of the longitudinal fibres, it has been proposed to use a pointed blade which partly penetrates into the cardboard and nicks the fibres contained in the cardboard To prevent tearing of the cardboard, the edge of the pointed blade is interrupted, by means of a milling operation, at regular intervals so as to form, in the cardboard, dotted scorelines with approximately 2 millimeters separating each pair of adjacent elongate dots. These dotted lines are formed in the inner portion of the groove so that they appear on the outer surface of the fold when this is formed in the cardboard. These dotted lines result in hollow portions which impart an unattractive appearance to the edge of the fold and which tend to open up so that a zone of weakness is created. Although this method can be used quite readily on a flat press, it may be difficult to apply in a rotary grooving machine.

The present invention aims at overcoming these various difficulties by providing a grooving method and apparatus which are simple to use and which enable a finished product of better quality to be obtained.

SUMMARY OF THE INVENTION

The present invention provides a method of grooving a flat thin material of fibrous structure, such as cardboard or paper, along a line about which the material is subsequently to be folded, the method comprising the step of forming along said line, an impression which provides on one side of the material a groove which is intended to form the outer face of the edge of the fold when the material has been folded, and provides, on the other side of the material, a corresponding bead which is intended to be located on the inside of the fold, wherein two parallel and opposite lines of elongate depressions are formed in the bead during the formation of the impression, the lines of depression being situated one on each side of the central longitudinal axis of the bead and each elongate depression being constituted by a portion of material which is of reduced thickness and which creates a localised zone of reduced strength.

The invention also provides apparatus for grooving a flat thin material of fibrous structure, such as cardboard or paper along a line about which the material is subsequently to be folded, the apparatus comprising a grooving blade having a generally trapezoidal end portion, a backing member having a recess of generally rectangular cross-section opposite the end portion of the blade, and means for displacing the grooving blade relatively to the backing member so as to move the flat on the trapezoidal end portion of the blade approximately into the plane of the opposite face of the backing member, wherein the two edges delimiting the recess in the backing member are provided with a plurality of notches which define bevelled surfaces which are, in use, substantially parallel to the lateral faces of the trapezoidal end portion of the grooving blade and which are spaced from these faces by a distance substantially equal to the thickness of the material to be grooved.

This method and apparatus offer the advantage of enabling the fibrous structure of the material to be considerably weakened both in the longitudinal and transverse directions without lines of elongate depressions appearing on the outer face of the subsequently formed fold. Consequently, the folded material, forming for example a packing carton, has an acceptable appearance along all its edges, and possesses increased strength.

BRIEF DESCRIPTION OF THE DRAWINGS

The invention will now be described in greater detail, by way of example, with reference to the accompanying drawings, in which.

DESCRIPTION OF PREFERRED EMBODIMENT

The grooving method and apparatus of the invention can be used both in flat presses and on rotary machines. In the following description, it will be assumed that grooving is carried out on a flat press.

Figure 1:
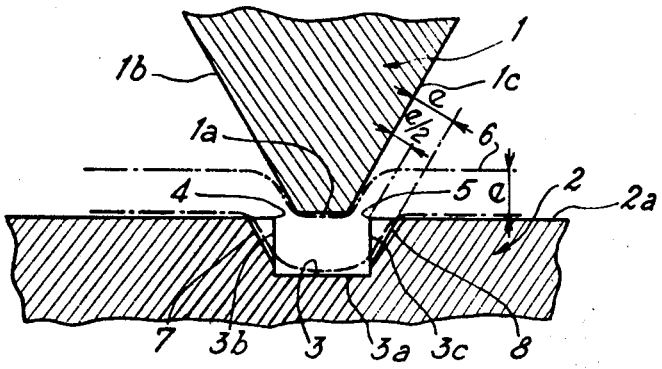
FIG. 1 is a diagrammatic vertical and transverse section through a grooving apparatus constructed in accordance with the invention.
Figure 2:
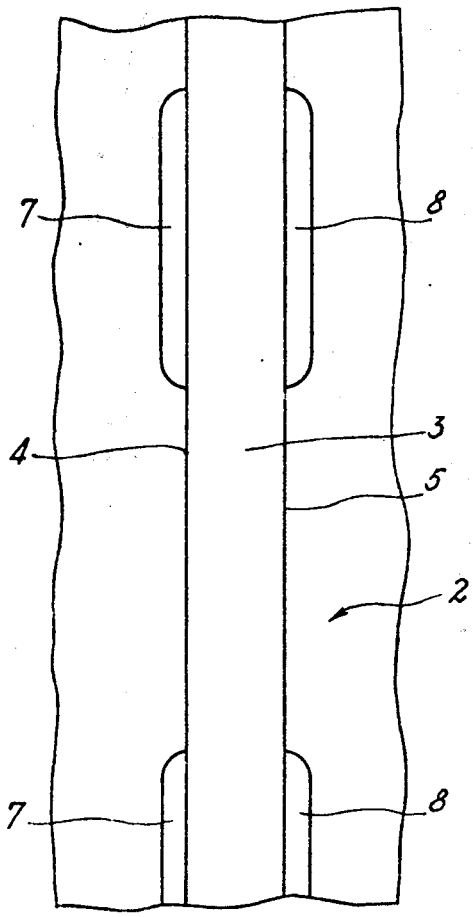
FIG. 2 is a plan view of part of the backing member of the grooving apparatus of FIG. 1.

As shown in FIGS. 1 and 2, the main components of the grooving blade 1 and backing member 2 which can be moved relatively to each other in both directions by means not illustrated. The backing member 2 is in fact, fixed, and the grooving blade 1 is pushed towards the backing member 2 during each grooving operation.

The grooving blade 1 has an end portion in the form of an isosceles trapezium, and it has an end face 1*a*, which constitutes a flat, contiguous with lateral faces 1*b* and 1*c*, one at each side of the flat and each forming an inclined side of the trapezium.

Opposite the grooving blade 1, the backing member 2 has a recess 3 of generally rectangular cross-section. This recess 3 has its open side at the upper surface 2*a* of the backing member 2. The recess 3 has a floor 3*a* which is parallel to the upper surface 2*a* of the backing member 2, and two side walls 3*b* and 3*c* which join the upper exterior surface 2*a* at parallel longitudinal edges 4 and 5.

Figure 3:
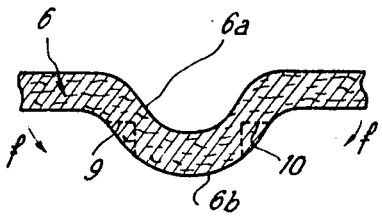
FIG. 3 is a cross-section through part of a sheet of cardboard grooved by the method of the invention, prior to folding.
Figure 4:
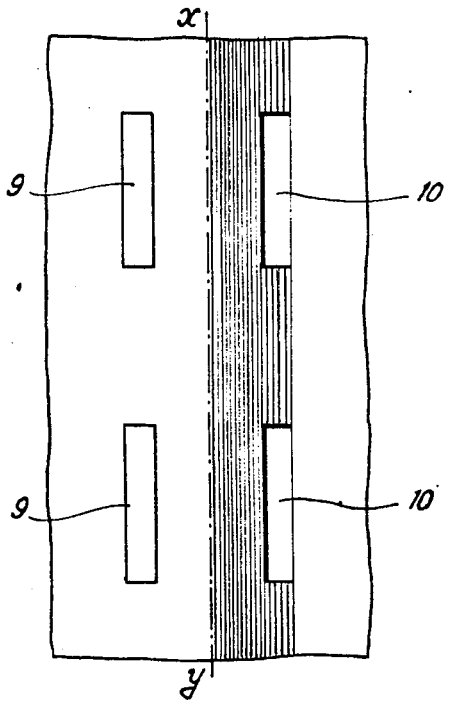
FIG. 4 is an underneath view of the sheet of cardboard shown in FIG. 3.

A sheet 6 of a thin flat material of fibrous structure, such as cardboard, is placed between the grooving blade 1 and the backing member 2 so that it can be scored when these two elements co-operate with each other. In FIG. 1, the grooving blade 1 is illustrated in the operating position in which it applies pressure to the portion of the sheet 6, engaged between the end face 1*a* of the blade and the backing member 2, and forces the material into the recess 3 formed in the backing member. Consequently, the grooving blade 1 forms a longitudinal impression which defines the line along which folding will be carried out and which, on the side facing the blade, is in the form of a groove 6*a*, which, after the material has been folded, forms the exterior face of the edge of the fold. On the other side of the impression is formed a bead 6*b* which will be located on the interior of the fold. FIG. 3 clearly shows the shape acquired by the sheet 6 after the grooving operation.

The edges 4 and 5 are each spaced in use, from the adjacent lower corner of the blade, by a distance substantially equal to one-half of the thickness e of the sheet of material 6. The width of the flat 1*a* forming the end face of the grooving blade 1 may vary between a value equal to the thickness e and twice this thickness, whereas the depth of the recess 3 is slightly greater than this thickness e.

The two edges 4 and 5 which delimit the recess 3 are notched at regular intervals so as to form, in the notched zones, bevelled surfaces 7 and 8 respectively which are substantially parallel to the respective oppositely disposed side faces 1*b* and 1*c* of the blade 1. These bevelled surfaces 7 and 8 are located at a distance from the respective side faces 1*b* and 1*c* that is substantially equal to the thickness e of the sheet of material 6.

Thus, during the grooving operation, while forming the longitudinal impression determining the fold line in the sheet of material 6, two parallel and opposite lines of elongate depressions 9 and 10 are formed simultaneously in the bead 6*b*, these lines of elongate depressions being located on both sides of the central longitudinal axis xy of the bead and each of the depressions being formed by a portion of the sheet 6 of reduced thickness, so that a localised zone of reduced strength is created. The depressions 9 and 10 are formed at the places where the edges 4 and 5 are un-notched, and at these places the sheet of material 6 is firmly compressed between the lateral faces 1*b* and 1*c* of the grooving blade 1 and the edges 4 and 5, compression continuing until a thickness substantially equal to one-half of the original thickness e is obtained. On the other hand, the thickness of the sheet of material 6 is not altered in those zones where the bevelled surfaces 7 and 8 are formed.

Figure 5:
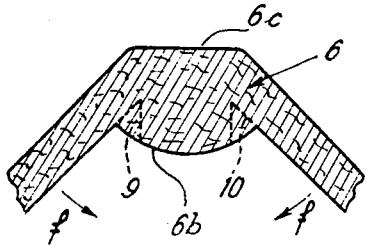
FIG. 5 is a cross-section through the grooved sheet of cardboard, during its folding.

In these conditions, when the sheet of material 6 is folded in the direction indicated by the arrows f in FIGS. 3 and 5, the groove 6*a* becomes stretched out to form the outer flat face 6*c* of the fold without interruption of its surface, whereas the elongate depressions 9 and 10 which facilitate folding are located in the bead 6*b* on the interior of the fold. Thus, it will be readily appreciated that the fold which is formed has an acceptable exterior appearance and that its strength is not reduced as the result of the presence of notches in the outer face 6*c*.

The spacing and length of the bevelled surfaces 7 and 8 will of course depend upon the degree of weakening that it is required to obtain in the fold zones.

In a modified arrangement, the bevelled surfaces 7 and 8 may be staggered instead of being arranged symmetrically in relation to one plane.

I claim:

1. Apparatus for grooving a flat thin material of fibrous structure, such as cardboard or paper, along a line about which the material is subsequently to be folded, the apparatus comprising a grooving blade which tapers towards an end face, and a backing member having a recess opposite the end face of the blade, the blade being displacable relative to the backing member so as to move the end face of the blade towards the base of the recess in the backing member, wherein the two edges delimiting the recess in the backing member are provided with a plurality of notches which define bevelled surfaces which match the tapering surfaces of the blade, which are generally parallel to said tapering surfaces and which are spaced from these surfaces by a distance substantially equal to the thickness of the material to be grooved.

2. Apparatus for grooving a flat thin material of fibrous structure, such as cardboard or paper, along a line about which the material is subsequently to be folded, the apparatus comprising a grooving blade having a generally trapezoidal end portion, a backing member having a recess of generally rectangular cross-section opposite the end portion of the blade, and means for displacing the grooving blade relatively to the backing member so as to move the flat on the trapezoidal end portion of the blade approximately into the plane of the opposite face of the backing member, wherein the two edges delimiting the recess in the backing member are provided with a plurality of notches which define bevelled surfaces which are, in use, substantially parallel to the lateral faces of the trapezoidal end portion of the grooving blade and which are spaced from these faces by a distance substantially equal to the thickness of the material to be grooved.

3. Apparatus according to claim 2, wherein the notches are provided at regular intervals along each of the two edges delimiting the recess in the backing member.

4. Apparatus according to claim 2, wherein the notches are arranged in pairs which are symmetrical in relation to the longitudinal plane of symmetry of the recess in the backing member.

5. Apparatus according to claim 2, wherein the notches provided in one edge of the recess are staggered with respect to the notches provided in the other edge of the recess.

6. Apparatus according to claim 2, wherein the two edges which delimit the recess between the notches are each spaced, in use, from the adjacent lateral face of the grooving blade by a distance which is substantially equal to one-half of the thickness of the sheet of material.

* * * * *